US005722797A

United States Patent [19]

Horton, III

[11] Patent Number: 5,722,797

[45] Date of Patent: Mar. 3, 1998

[54] FLOATING CAISSON FOR OFFSHORE PRODUCTION AND DRILLING

[75] Inventor: Edward E. Horton, III, Rancho Palos Verdes, Calif.

[73] Assignee: Deep Oil Technology, Inc., Houston, Tex.

[21] Appl. No.: 604,520

[22] Filed: Feb. 21, 1996

[51] Int. Cl.[6] ..... B63B 35/44

[52] U.S. Cl. ..... 405/224; 405/195.1; 114/264

[58] Field of Search ..... 405/195.1, 198, 405/219, 223.1, 224; 166/350, 351, 352; 114/256, 257, 264, 265, 266

[56] References Cited

U.S. PATENT DOCUMENTS

| | | | |
|---|---|---|---|
| 3,191,388 | 6/1965 | Ludwig | 114/264 X |
| 3,224,401 | 12/1965 | Kobys | 114/265 |
| 3,510,892 | 5/1970 | Monnereau et al. | 114/264 |
| 3,540,396 | 11/1970 | Horton | 405/223.1 X |
| 3,548,602 | 12/1970 | Monnereau | 405/219 X |
| 3,648,638 | 3/1972 | Blenkarn | 114/265 |
| 4,626,137 | 12/1986 | Willemsz | 405/224 |
| 4,906,139 | 3/1990 | Chiu et al. | 405/224 |
| 4,987,896 | 1/1991 | Yamashita et al. | 114/266 X |

*Primary Examiner*—Tamara L. Graysay
*Assistant Examiner*—Frederick L. Lagman
*Attorney, Agent, or Firm*—Robert J. Edwards; D. Neil LaHaye

[57] ABSTRACT

A floating caisson for offshore drilling and production that includes means for increasing the natural period of the caisson and reducing heave, pitch, and roll without increasing the overall length of the caisson. The caisson is self buoyant by means of buoyancy tanks and is held in position by mooring lines. The caisson has a center well through which drilling and/or production risers pass. One or more plates extend radially from the caisson below the water surface. The plates provide additional mass and resistance to environmentally induced motions and thus increase the natural period of the caisson beyond the periods of maximum wave energy. This allows the caisson to be designed with a shallower draft than a caisson without the plates that would normally be used in deep water.

2 Claims, 3 Drawing Sheets

FLOATING CAISSON FOR OFFSHORE PRODUCTION AND DRILLING

BACKGROUND OF THE INVENTION

1. Field of the Invention

The invention is generally related to an offshore apparatus for use in drilling and production of offshore wells and more particularly to a deep draft floating caisson.

2. General Background

In offshore test, drilling, and production operations, prior proposed floating structures have included a long vertically disposed floating hull, body, or caisson with the upper portion of the structure above the water and the lower portion of the structure immersed in the water a selected depth. The entire structure is subjected to winds, currents, and variable wave motion that causes a heave response in the structure. Means to stabilize the structure against heave, pitch, and roll motions have been proposed that include the use of horizontally disposed areas vertically spaced along the longitudinal axis of the structure to modify the heave response of the structure. Such spacing was very great as shown in U.S. Pat. Nos. 3,404,413 and 3,510,892. The use of relatively wide large horizontal surface areas that act as virtual mass trap means is described in U.S. Pat. No. 4,516,882 where the use of such areas is in connection with conversion between tension leg platform and semi-submersible modes. Such a prior apparatus also included an anchor system in which mooring lines were connected with the lower portion of the hull structure and connected to anchor means in the sea floor in a gravity catenary mode or in a taut mode with the lines under tension. In some instances, the bottom of the floating structure included ballast means. Pending U.S. patent application assigned Ser. No. 08/336,377 now U.S. Pat. No. 5,558,467 discloses a floating caisson having a frame connected at the lower end of the caisson. The frame extends down from the caisson and has a plurality of vertically spaced bays that effective trap water to reduce heave, pitch, and roll motions of the floating caisson. Drilling and production in shallower waters may preclude the use of such elongated structures. Therefore, this leaves a need for a structure or means for reducing heave, pitch, and roll of a floating caisson that will be positioned in relatively shallow water.

SUMMARY OF THE INVENTION

The invention addresses the above need. What is provided is a floating caisson for offshore drilling and production that includes means for increasing the natural period of the caisson and reducing heave, pitch, and roll without increasing the overall length of the caisson. The caisson is self buoyant by means of buoyancy tanks and is held in position by mooring lines. A deck and drilling rig are positioned on top of the caisson. The caisson has a center well through which drilling and/or production risers pass. One or more plates extend radially from the caisson below the water surface. This provides additional mass and resistance to environmentally induced motions and thus increases the natural period of the caisson beyond the periods of maximum wave energy. This allows the caisson to be designed with a shallower draft than a caisson without the plates that would normally be used in deep water.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
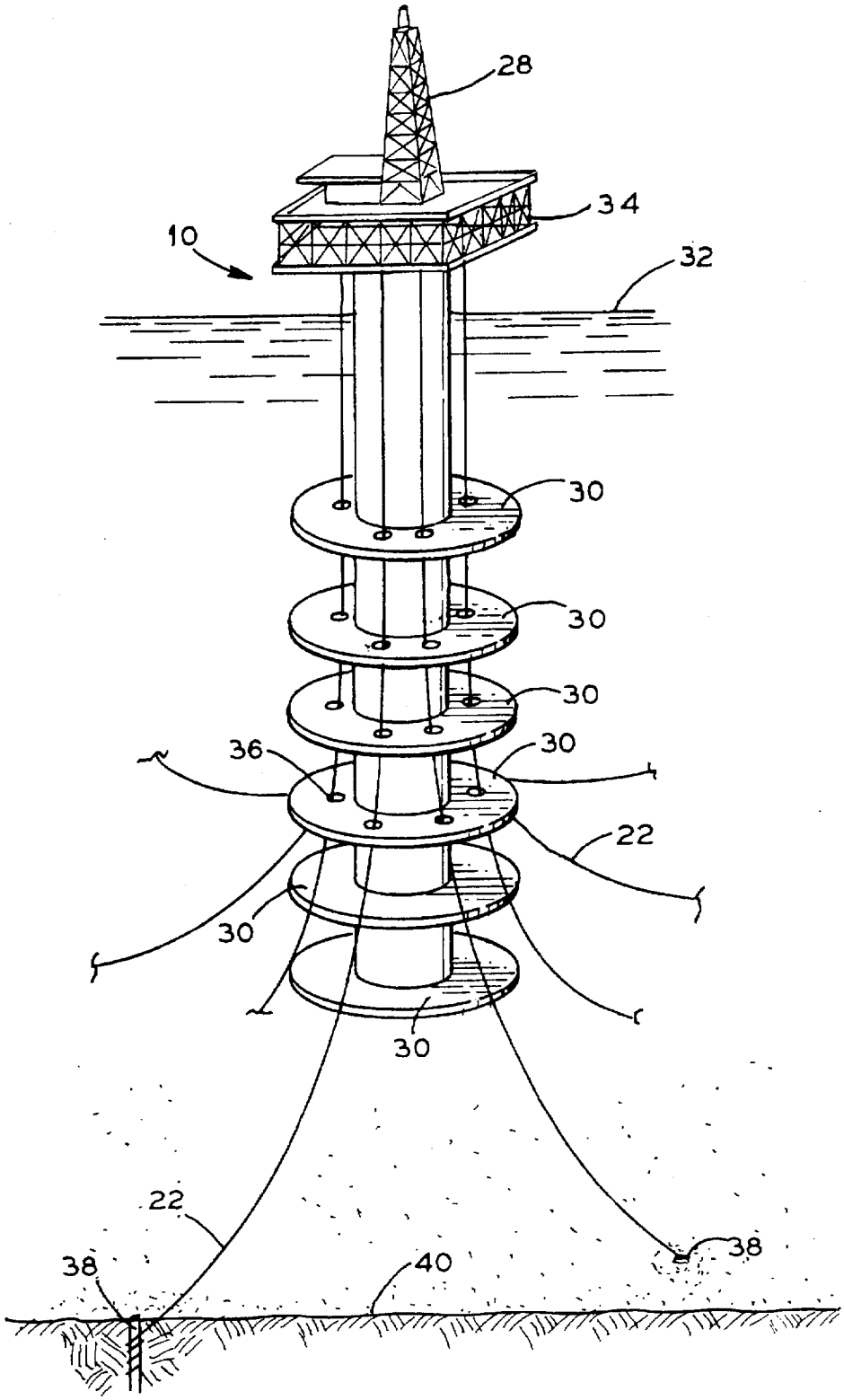
FIG. 1 is a perspective view of the invention.
Figure 2:
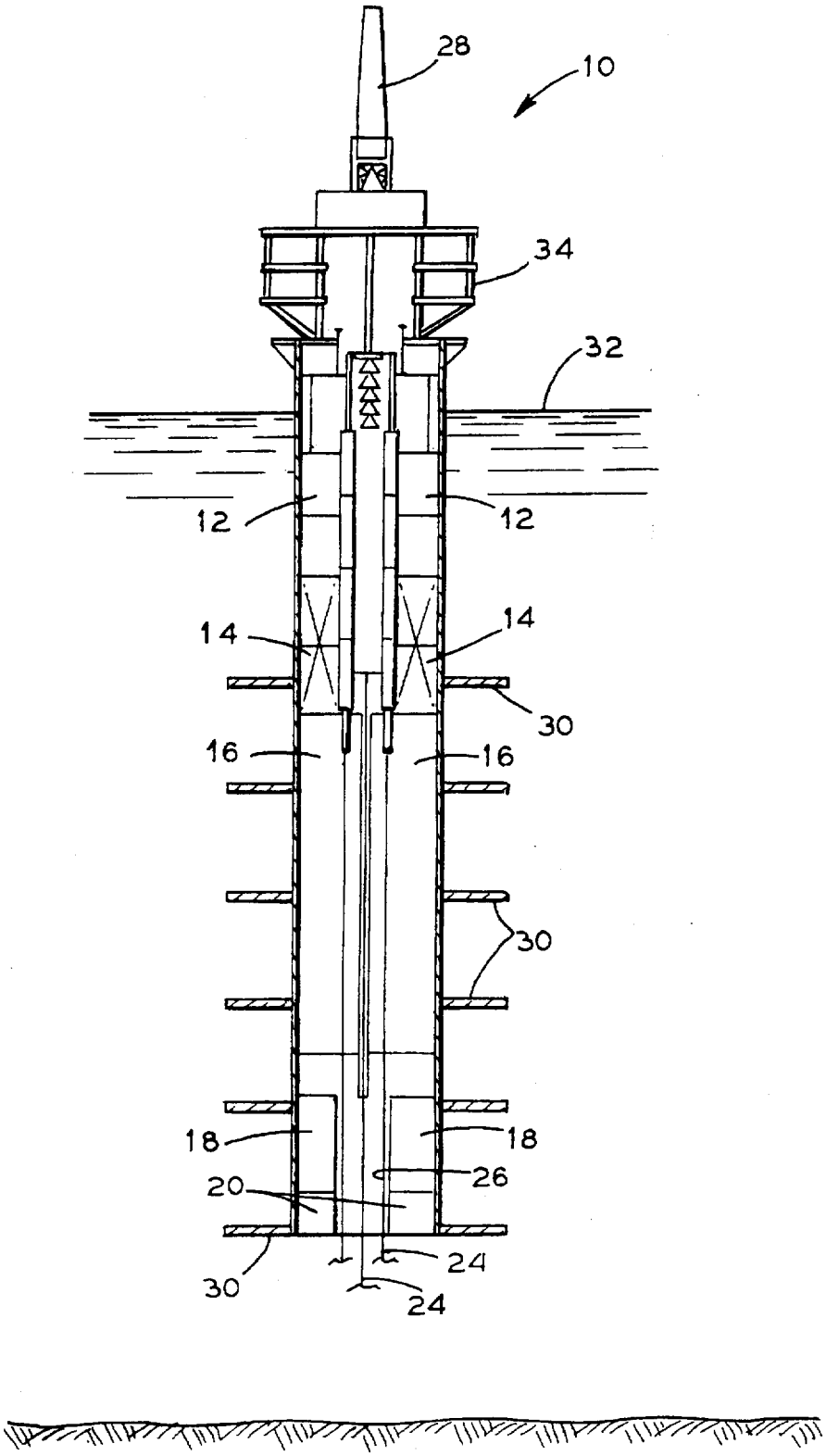
FIG. 2 is a side sectional view of the invention.

Referring to the drawings, it is seen in FIG. 1 that the invention is generally indicated by the numeral 10. Although the basic structure of floating caisson 10 is known as that described in U.S. Pat. No. 4,702,321, a general description of the structure of caisson 10 is provided for the sake of clarity. As seen in FIG. 2, caisson 10 is self buoyant by means of buoyancy tanks 12, and may be of any suitable cross section. Although the cross section of the caisson 10 may vary along its length, there are situations where it will be preferable that the caisson is of uniform cross section throughout its length. Caisson 10 may include variable ballast 14, oil storage compartments 16, trim tanks 18, and fixed ballast tanks 20. As seen in FIG. 1, caisson 10 may be held in position by mooring lines 22. Risers 24 may be used for drilling or production and extend through a center well 26 in caisson 10 up to a blow-out-preventer at the surface. A drilling rig 28 may be positioned on top of caisson 10.

Whereas a typical floating caisson used in deep water will have a draft of five hundred to seven hundred feet, caisson 10 will instead have a shallower draft of three hundred to four hundred feet. Low heave responses in this case are accomplished by including a plurality of plates 30 along the length of caisson 10. Plates 30 begin at or near the lower end of caisson 10 and are spaced along the length of caisson 10. Plates 30 are rigidly attached to extend radially outward from caisson 10 so as to be horizontal relative to the water surface 32 when caisson 10 is in its installed position at sea. The plates 30 act to effectively trap water between the plates during heave motions induced by waves and currents. The effectively trapped water gives additional mass, which increases the natural period of caisson 10 and shifts the natural period beyond the periods of maximum wave energy. This results in the ability to design caisson 10 to have a shallower draft than previous caissons. Another advantage is that the shorter length requires less strengthening for towing and upending, which means that less steel is required to build the caisson and thus reduces the cost. Also, the caisson can be used in shallower water. The upper portion of the caisson 10 extends above the water approximately fifty feet and supports the drilling rig 28 and deck 34. Although the plates 30 are illustrated as being evenly spaced apart, the spacing between the plates may vary depending upon the desired effect upon the natural period of the caisson 10.

Figure 3:
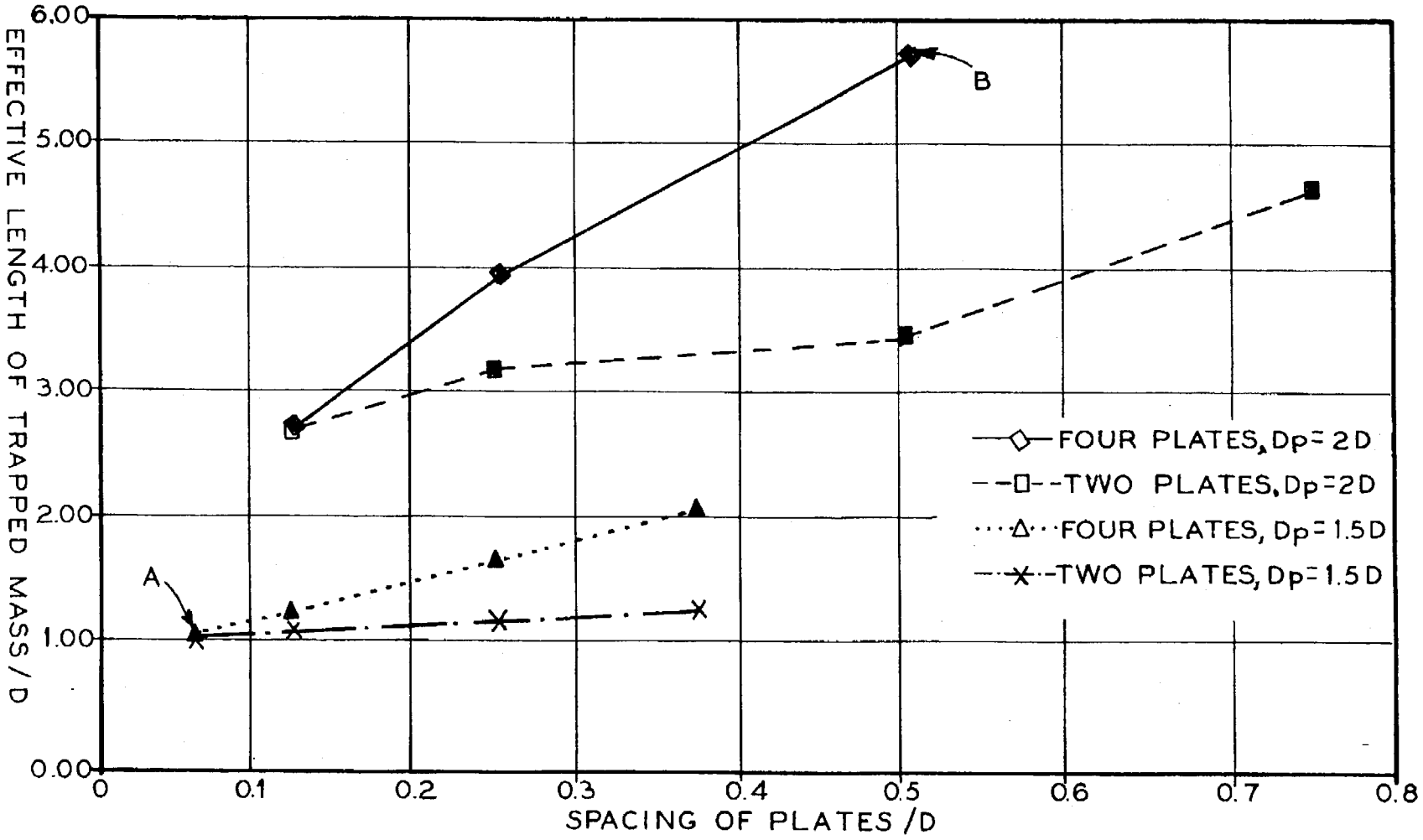
FIG. 3 is a chart that illustrates the effect of different plate spacing and diameter and number of plates.

This may be illustrated by reference to FIG. 3, which was derived from model tests conducted of various plate and caisson configurations. The trapped mass of the plates has the effect of increasing the apparent draft of the spar from the standpoint of responses. For example, in FIG. 3, the effect of having two plates with a spacing of 0.06 D (i.e., 0.06 times the diameter of the caisson) and having a plate diameter of 1.5 D (i.e., 1.5 times the caisson diameter ) is to increase the apparent draft by approximately one diameter. This is shown as point A in FIG. 3. Alternately, point B shows that four plates spaced at 0.5 D and 2 D in diameter would increase the apparent draft by almost six diameters.

The spacing and size of plates desired depends upon the design wave, wind, and current environment, which is different in different areas of the world. In the Gulf of Mexico, for example, where the design of caissons is governed largely by hurricanes, the desired draft of a straight sided caisson is between 500 and 700 feet for reduced heave responses. For a caisson limited in draft to 300 feet and with a diameter of 100 feet, an effective length of trapped mass of about 300 feet, or three diameters is desired. From FIG. 3, it appears this could be achieved with four plates, 1.5 D in diameter and spaced at 0.3 to 0.5 diameters. If the spar is only 70 feet in diameter, the corresponding increase in effective draft would require an effective length of trapped mass equal to four diameters. This would require the spacing to be increased to about 0.7 diameters, or the diameter of the plate would have to be increased for a closer spacing.

Another example would be the North Sea where the design wave environment has a longer period, and an effective draft of 700–800 feet is desirable. In this case, slightly greater spacing and diameters might be desirable.

In areas of milder environments, the spacing and diameter of the plates could be reduced.

As a general guideline, in areas of severe environments such as the Gulf of Mexico and the North Sea, a practical plate design would have a diameter of about 1.75 D and a spacing of 0.6 D.

The mooring lines 22 are attached at one end to an anchor 38 embedded in the sea floor 40 and at the opposite end to the caisson 10. As seen in FIG. 1, one method of attaching the mooring lines 22 to the caisson 10 is to run them through fairleads 36 in the plates 30. The fairleads 36 prevent chafing or cutting of the mooring lines 22 and allow the mooring lines to be attached to the caisson 10 at any desired point along its length. In FIG. 1, the mooring lines 22 are attached at the top of the caisson 10.

The caisson 10 may be built horizontally in a building berth, like a ship, and launched. The plates 30 can then be added while the caisson 10 is floating. If draft is a problem at the building/floating area, the upper portion of the plates can be installed while the caisson 10 is in the building berth or floating. The caisson 10 can then be towed to a deeper draft location and rolled so that the previously installed portion of the plates 30 are in the water and the remaining portions of the plates 30 can be installed above the water.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A self buoyant, floating deep draft caisson having a draft greater than two hundred feet for use in drilling and production of wells offshore, the improvement comprising:

a. one or more plates that extend radially outward from the lower portion of the caisson located at the depth at which the water is relatively unaffected by wave motion when the caisson is in its operative installed position; and b. a plurality of mooring lines each attached at one end to the caisson, said mooring lines being received in fairleads through one or more of said radially extending plates.

2. A self buoyant, floating deep draft caisson having a draft greater than two hundred feet for use in drilling and production of wells offshore, the improvement comprising:

a. a plurality of plates that extend radially outward from the lower portion of the caisson located at the depth at which the water is relatively unaffected by wave motion when the caisson is in its operative installed position, said plates each having a diameter that is approximately 1.75 times the diameter of the caisson and being spaced apart a distance that is approximately sixty percent of the diameter of the caisson; and b. a plurality of mooring lines each attached at one end to the caisson, said mooring lines being received in fairleads through one or more of said radially extending plates.

* * * * *